United States Patent [19]

Jansen

[11] 4,097,038

[45] Jun. 27, 1978

[54] HEADREST

[76] Inventor: Alan A. Jansen, 4201 SW. 47th Dr., Portland, Oreg. 97221

[21] Appl. No.: 838,244

[22] Filed: Sep. 30, 1977

[51] Int. Cl.[2] ..... A61G 13/00

[52] U.S. Cl. ..... 269/328

[58] Field of Search ..... 269/328; 5/327 B, 327 R

[56] References Cited

U.S. PATENT DOCUMENTS

| | | | |
|---|---|---|---|
| 3,806,110 | 4/1974 | Glasser et al. | 269/328 |
| 4,030,719 | 6/1977 | Gabriele et al. | 269/328 |

*Primary Examiner*—Robert C. Watson

*Attorney, Agent, or Firm*—Hill, Gross, Simpson, Van Santen, Steadman, Chiara & Simpson

[57] ABSTRACT

A headrest, especially suited for suspending the head of a patient over the detector of a gamma ray brain scanning or X-ray apparatus, has a three-sided body sized for freely embracing the patient's head and supports a head cradling sling tape draped over the tops of the side walls of the body and releasably secured to the outer faces of the side walls by fasteners on the tape and side walls which adhere when pressed together. A second similar tape is also draped over the tops of the sidewalls and releasably anchored to the side walls to engage the patient's forehead for immobilizing the head. The fasteners are preferably "Velcro" tapes with the hook tapes secured to the outer faces of the side walls of the body near the top edges thereof while the head cradling and forehead engaging tapes have pile or loops interlocking with the hook tapes. The body is preferably formed of transparent molded plastics material with openings therethrough level with the patient's ears to facilitate conversation, to provide ventilation, and to serve as hand holes for grasping the body.

11 Claims, 6 Drawing Figures

HEADREST

FIELD OF THE INVENTION

This invention relates to the art of headrests and is particularly concerned with the comfortable suspension of a patient's head in brain scanning apparatus, X-ray machines, and the like.

SUMMARY OF THIS INVENTION

According to this invention, there is provided a portable, lightweight, easily adjustable, non-confining headrest especially suited for comfortably suspending a patient's head over brain scanning, X-ray, or the like apparatus to provide superior pictures, especially of the posterior fossa region of the brain.

The headrest has a unitary support body with upstanding side and end walls adapted to rest upright on the apparatus to freely receive therein the head of a patient lying supine on the table of the apparatus. The body is preferably formed of clear transparent plastics material such as an acrylic resin of the "Lucite" type manufactured by E. I. Du Pont Company or the "Plexiglas" type manufactured by Rohm and Haas Company. The molded body is large enough to freely embrace a patient's head without producing a feeling of confinement.

A convenient all purpose size for the body has walls about 12 inches long and about 10 inches high. Each of these walls preferably has a large horizontal major axis oval opening in the center thereof to facilitate conversation with the patient, to allow free ventilation, and to provide hand grips for adjusting and lifting the body.

The outer faces of the side walls have longitudinally extending fastener tapes secured thereto near the top edges thereof. Cooperating fastener tapes are draped over the top edges of the side walls and releasably anchored to the horizontal tapes to provide a head cradling sling and a forehead engaging restraint to comfortably and immovably suspend a patient's head over the detection portion of the apparatus.

The fastener tapes are preferably of the "Velcro" type supplied by Velcro Corporation of New York and disclosed in the art, for example, in the George de Mestral U.S. Pat. Nos. 3,009,235 and 3,114,951. It will be understood, however, that other fasteners composed of materials which adhere when pressed together may be used.

The head suspending and restraining tapes are freely slidable over the top edges of the side walls of the body to facilitate adjustment of the tapes without pulling the side walls toward each other. The interlocked cooperating fasteners on the outer faces of the side walls and the underfaces of the tapes thus only need resist stresses from the suspended patient's head which are parallel with the vertical planes of the side walls.

Thus, the free draping of the tapes over the top edges of the side walls and the fastening of the ends of the tape parallel with the side walls not only facilitates adjustment but also limits the anchoring stresses to vertical planes.

Detachment of the tapes is easily accomplished by an outward pulling of the free ends of the tapes perpendicularly to the planes of the adjacent side walls.

It is then an object of this invention to provide a non-obstructing comfortable sling-type headrest for brain scanning and X-ray machines.

Another object of this invention is to provide a lightweight, portable, comfortable headrest having a three-sided body adjustably supporting a head cradling tape draped over the side walls of the body and selectively anchored to the outer faces of the side walls.

A further object of the invention is to provide a headrest for suspending a patient's head over detection apparatus on "Velcro" tape which does not interfere with detection.

A still further object of the invention is to provide a headrest with upright side and end walls for freely embracing a human head and having an adjustable sling draped over the top edges of the side walls and releasably secured to the side walls.

A specific object of this invention is to provide a headrest for brain scanning apparatus having a molded plastics body with upright side and end walls, "Velcro" tapes secured to the outer faces of the side walls, and "Velcro" tapes draped over the top edges of the side walls to suspend and restrain a human head and adjustably anchored to the "Velcro" tapes on the side walls.

Other and further objects of this invention will become apparent to those skilled in this art from the following detailed description of the annexed sheet of drawings which, by way of a preferred example, illustrates one embodiment of the invention.

ON THE DRAWINGS

AS SHOWN ON THE DRAWINGS

Figure 1:
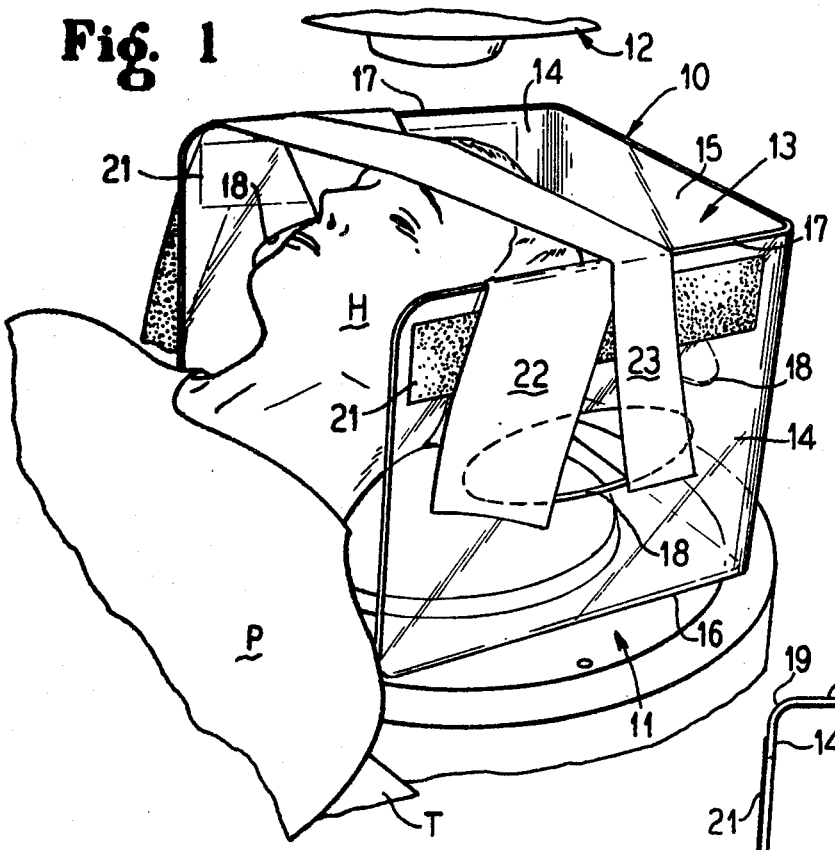
FIG. 1 is a perspective view of a headrest according to this invention supported on the detector of a gamma ray brain scanning machine and suspending the head of a patient over the detector.

In FIG. 1, the reference numeral 10 designates generally a headrest according to this invention supported on the detector 11 for gamma rays emitted from a source 12 of a brain scanning apparatus and showing a patient P lying supine on the table T of the apparatus with his head H suspended and restrained in the headrest 10 over the detector 11 and under the ray source 12.

The headrest 10 has a three-sided body 13 with upright side walls 14, 14 and an end wall 15 sized and shaped to freely embrace the patient's head H in spaced relation. The body 13 thus has an open top, an open bottom, and an open front. The body is preferably composed of clear transparent plastics material such as "Lucite" or "Plexiglas" and is rigid, light in weight, with bottom end edges 16 resting on the detector 11 and top end edges 17 spaced above the bottom edges 16 a sufficient distance to substantially confine the patient's head H. A practical size for the body 10 is to have the walls about 10 inches high and about 12 inches long.

The sidewalls 14, 14 and the end wall 15 have oval holes 18 therethrough with major axes thereof extending horizontally at about the vertical center of the walls. The holes 18 are sufficiently large to comfortably receive a human hand so that the body 13 may be easily grasped for adjustment on the support 11 and for carrying purposes.

Figure 3:
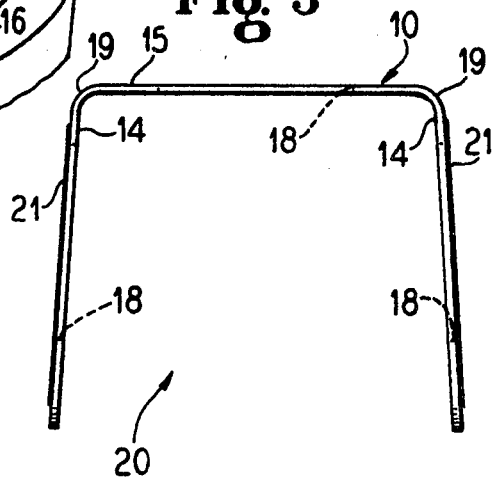
FIG. 3 is a top plan view of the headrest.
Figure 4:
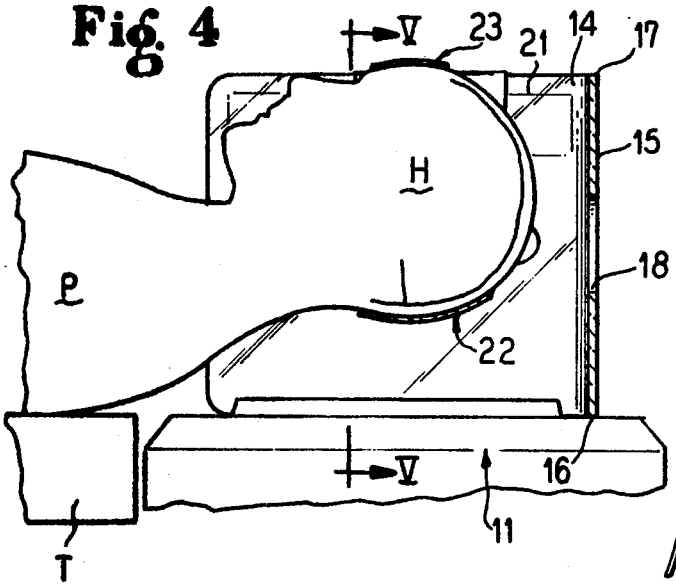
FIG. 4 is a longitudinal vertical cross sectional view taken generally through the longitudinal center of FIG. 1.

As shown in FIG. 3, the sidewalls 14, 14 merge into the end wall 15 through rounded corners 19 providing bends of greater than 90° so that the sidewalls 14 flare outwardly from the end wall 15 providing an entrance open front end 20 wider than the rear end closed by the wall 15.

Figure 2:
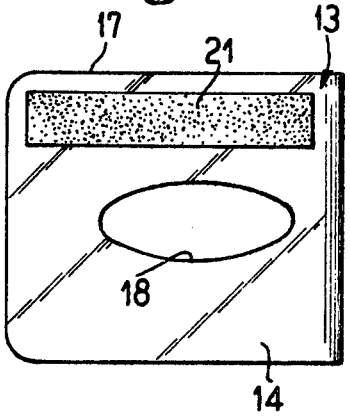
FIG. 2 is a side elevational view of the headrest.

The outer faces of the side walls 14, 14 have "Velcro" hook tapes 21 adhesively secured thereto and extending horizontally along substantially the entire length of the side wall below the top edge 17 thereof. These tapes 21 do not extend over the top edges 17 and, as shown in FIGS. 1 and 2, have their top edges actually spaced below the top edges 17 providing a margin between the tapes and top edges.

A wide "Velcro" pile tape 22 is draped over the top edges 17 of the body 13 and has free ends overlapping the tapes 21 with portions detachably secured thereto. Thus, the underface of the tape 22 has piles or loops interlocking with the hooks on the outer faces of the tapes 21. The tapes 22 extend beyond the tapes 21 to provide accessible free end tabs.

Figure 5:
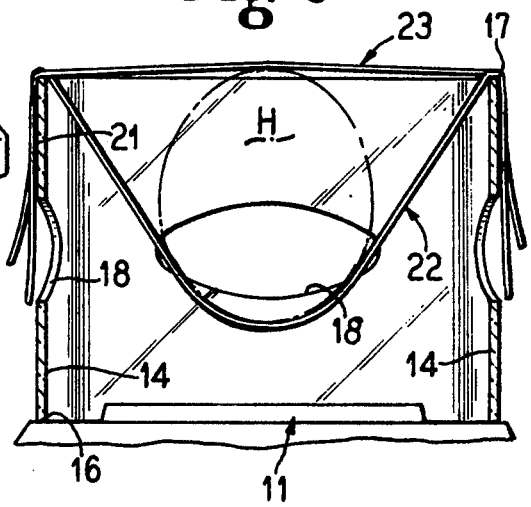
FIG. 5 is a transverse vertical cross sectional view taken along the line V—V of FIG. 4.

The head H of the patient P is cradled on that portion of the tape 22 spanning the side walls 14, 14 and the tape is adjusted so that the back of the patient's head H will be suspended in spaced relation above the bottom edges 16 over the detector 11 and, as shown in FIG. 5, midway between the side walls 14, 14.

A second narrower "Velcro" pile or loop tape 23 is draped over the top end edges 17 of the side walls 14 and is drawn taught over the forehead of the patient's head H to restrain the head against movement relative to the headrest. The free ends of the tape 23 also have intermediate portions interlocked with the tabs 21 and loose end tab portions projecting beyond the tapes 21.

As shown in FIG. 1, the tapes 22 and 23 may be drawn somewhat diagonally over the tapes 21 so as to be locked thereto in side by side relation.

Since the top end edges 17 and adjacent margins of the side walls 14 are smooth, the tapes 22 and 23 may easily slide over the edges to adjust the patient's head as desired within the confines of the body 13 and when the tapes are pressed against the hook tapes 21, the stresses are applied to the side walls in vertical planes thereby minimizing the tendency of the loads on the tapes from drawing the side walls toward each other.

The free ends of the tapes beyond the tapes 21 are easily grasped to pull the tapes perpendicularly away from the tapes 21 to release the tapes 22 and 23 from the body 13.

The tapes 22 and 23 thus comfortably cradle the patient's head H within the body 13 but spaced from the walls of the body so as to eliminate any trauma of confinement and to allow free circulation of air through the body around the patient's head. The holes 18 facilitate air flow and also, being level with the patient's ears, provide for free conversations with the patient.

Figure 6:
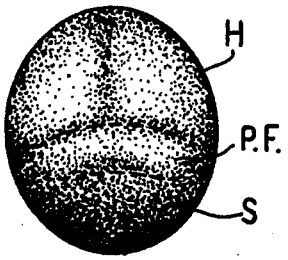
FIG. 6 is a somewhat diagrammatic gamma ray brain scan picture emphasizing the clarity of the posterior fossa region obtained when the patient's head is suspended on the headrest of this invention.

As shown in the brain scan picture S of FIG. 6, the Posterior Fossa area P. F. of the patient's head H is unemcumbered by any ray distorting or deflecting portion of the headrest and the brain scan picture S in this area P. F. is clear and undistorted.

From the above descriptions, it should, therefore, be clearly understood that this invention provides a simple, light-weight, non-confining headrest and restraint for detecting apparatus such as gamma ray scanning machines, X-ray machines, and for other head supporting purposes.

I claim as my invention:

1. A headrest which comprises a U-shaped body with an open unobstructed front, top and bottom having upstanding side walls connected by an end wall sized to freely surround a human head, said side walls having bottom edges for resting on a supporting surface and smooth top edges, a flexible sling tape draped over said smooth top edges and suspended from said side walls for cradling a human head projecting through said open unobstructed front within the body in spaced relation from the side and end walls above the bottom of the body, annd cooperating fastener materials on the sling tape and outer faces of the side walls adhering when pressed together to adjustably anchor the sling to the side walls.

2. The head rest of claim 1 wherein said U-shaped body is a transparent rigid resin material.

3. The head rest of claim 1 wherein the U-shaped body has at least one hand grip hole in a wall thereof.

4. The head rest of claim 3 wherein a hand grip hole is provided in each of the side walls.

5. The head rest of claim 1 including a head restraining sling suspended from said side walls cooperating with said flexible sling tape to restrain movement of a human head cradled on said flexible sling tape.

6. The head rest of claim 5 wherein said head restraining sling is positioned to overlie the forehead of a human head cradled in said head rest on said flexible sling tape.

7. The head rest of claim 1 wherein the side walls of said U-shaped body diverge from said end wall to provide an open unobstructed front of greater width than the end wall.

8. The head rest of claim 1 wherein the side walls of the support are about 12 inches long and about 10 inches high.

9. The head rest of claim 1 wherein the cooperating fasteners materials on the sling tape and outer faces of the side walls are "Velcro" tapes.

10. A head rest for suspending and restraining a patient's head in a detection apparatus which comprises a U-shaped plastics material member having open unobstructed front, top and bottom portions with upstanding side walls connected by an end wall, said side and end walls having bottom end edges for resting on a horizontal support surface of a detection apparatus to present the side walls in a vertical plane normal to said horizontal support surface, said side walls having smooth top end edges, "Velcro" tapes secured to the outer faces of said side walls, a "Velcro" tape sling draped over said smooth top edges of said side walls forming a head support between said side walls and having end portions releasably secured to the "Velcro" tapes on said side walls.

11. The head rest of claim 10 including a second "Velcro" tape sling draped over the smooth top edges of said side wall for overlying the patient's head to immobilize the head and said second tape being adjustably and releasably fastened to the "Velcro" tapes secured to the outer faces of said side walls.

* * * * *